US007600620B2

(12) United States Patent
Hammond

(10) Patent No.: US 7,600,620 B2
(45) Date of Patent: Oct. 13, 2009

(54) APPARATUS AND METHOD FOR ENABLING A BRIEFCASE TO CARRY A SUPPLEMENTAL BAG

(76) Inventor: Richard P. Hammond, 5962 S. Schooner Pl., Boise, ID (US) 83716

( * ) Notice: Subject to any disclaimer, the term of this patent is extended or adjusted under 35 U.S.C. 154(b) by 59 days.

(21) Appl. No.: 11/457,746

(22) Filed: Jul. 14, 2006

(65) Prior Publication Data

US 2008/0011567 A1 Jan. 17, 2008

(51) Int. Cl.
*A45C 3/02* (2006.01)
*A45C 3/12* (2006.01)
*A45C 13/02* (2006.01)

(52) U.S. Cl. ..... 190/108; 109/102; 150/111; 383/37

(58) Field of Classification Search ..... 190/101, 190/102, 108, 110; 150/101, 111, 113; 383/37; 224/407, 582, 666
See application file for complete search history.

(56) References Cited

U.S. PATENT DOCUMENTS 676,310 A * 6/1901 Goldberg ..... 190/102
746,617 A * 12/1903 Wenzell ..... 190/102
922,567 A * 5/1909 Cosgrove ..... 190/108
1,084,360 A * 1/1914 Rahm ..... 190/108
1,110,150 A * 9/1914 Slavin et al ..... 190/102
1,841,154 A * 1/1932 Rath ..... 190/109
2,591,379 A * 4/1952 Schradermeier ..... 150/113
2,691,400 A * 10/1954 Giordano ..... 190/111
2,796,905 A * 6/1957 Hebron ..... 150/133
2,979,098 A * 4/1961 Greaves ..... 224/275
2,989,998 A * 6/1961 Harris ..... 190/108
3,326,258 A * 6/1967 Stucker ..... 150/115
3,587,698 A * 6/1971 Ritter ..... 150/116
3,696,850 A * 10/1972 Rosenblum ..... 190/108
3,796,905 A * 3/1974 Tomii et al. ..... 313/375
3,982,613 A * 9/1976 Wood ..... 190/116
4,177,909 A * 12/1979 Haskell ..... 224/153
4,250,938 A * 2/1981 Siegel ..... 150/111
4,257,463 A * 3/1981 Monaco ..... 150/111
4,420,068 A * 12/1983 Gerch ..... 190/102
D274,101 S * 6/1984 Silk ..... D3/233
4,532,972 A * 8/1985 Sinsko ..... 150/100
4,804,122 A * 2/1989 Knox ..... 224/220
4,974,709 A 12/1990 Furlow et al.

(Continued)

FOREIGN PATENT DOCUMENTS

JP 2001112540 4/2001

(Continued)

*Primary Examiner*—Sue A Weaver
(74) *Attorney, Agent, or Firm*—Marger Johnson & McCollom, P.C.

(57) ABSTRACT

An improved storage bag has a retaining member disposed on an inside surface of a first side wall of a main bag. The retaining member allows supplemental bag to hang on an outside wall of the main bag. An existing storage bag can have a bracket configured to extend partially along an inside portion of a side wall of the briefcase. The bracket has a hook-portion to extend out of the top of the briefcase and partially along the outside portion of the side wall of the briefcase and a retaining member. This configuration also allows a supplemental bag to be attached to the retaining member to hang along an outside wall of the bag.

7 Claims, 3 Drawing Sheets

U.S. PATENT DOCUMENTS

| | | | | |
|---|---|---|---|---|
| 5,018,609 | A * | 5/1991 | Brenner | 190/108 |
| 5,031,766 | A * | 7/1991 | Cohen | 206/289 |
| 5,186,290 | A | 2/1993 | Takayama | |
| 5,207,303 | A * | 5/1993 | Oswalt et al. | 190/108 |
| 5,402,869 | A | 4/1995 | Saltzman et al. | |
| 5,509,515 | A | 4/1996 | Guo | |
| 5,533,656 | A * | 7/1996 | Bonaldi | 224/667 |
| 5,544,792 | A | 8/1996 | Arnwine | |
| 5,628,443 | A | 5/1997 | Deutsch | |
| 5,713,439 | A | 2/1998 | Zionts et al. | |
| 5,779,036 | A | 7/1998 | Westbrook et al. | |
| 5,934,527 | A | 8/1999 | Von Neumann | |
| 5,947,241 | A | 9/1999 | Rausch | |
| 6,092,661 | A * | 7/2000 | Mogil | 206/579 |
| 6,230,771 | B1 | 5/2001 | Hellenbrand | |
| 6,283,183 | B1 * | 9/2001 | Cooper | 150/112 |
| 6,502,951 | B2 * | 1/2003 | Marshall | 362/156 |
| 6,869,219 | B1 | 3/2005 | Sala | |
| 2002/0179664 | A1 | 12/2002 | Worden, IV et al. | |
| 2006/0102670 | A1 * | 5/2006 | Hassett et al. | 224/407 |
| 2006/0180624 | A1 * | 8/2006 | Sadow et al. | 224/582 |
| 2006/0254952 | A1 * | 11/2006 | Trevino et al. | 206/581 |

FOREIGN PATENT DOCUMENTS

| | | |
|---|---|---|
| WO | 0149145 | 7/2001 |

* cited by examiner

APPARATUS AND METHOD FOR ENABLING A BRIEFCASE TO CARRY A SUPPLEMENTAL BAG

BACKGROUND

This disclosure relates generally to briefcases. More particularly, this disclosure relates to briefcases adapted to facilitate the convenient attachment of a supplemental bag in order to allow a user to carry additional items such as a pair of shoes.

Millions of commuters and global travelers use a briefcase in one form or another. Many of these commuters have need to carry additional items that may not normally fit in a briefcase. As a result, they are forced to carry additional bags or use other cumbersome solutions. One good example of additional items a commuter may need to carry is a change of shoes. It is often desirable to have one pair of shoes for traveling that can provide extra comfort and/or protection from inclement weather, while having another pair for wearing in a work environment.

Many solutions have been attempted to allow for convenient carrying of such items. These solutions are usually implemented on backpacks by placing extra carrying cases on the backpack in a saddlebag-like manner. Unfortunately, because of the differences between normal carrying methods of backpacks and briefcases, implementing these solutions on briefcases is overly cumbersome. These solutions also usually have straps or other retainers on the outside of the main bag which can be undesirable for aesthetic purposes.

Accordingly, the need remains for an improved way to place one or more supplemental bags on a briefcase that can allow for comfortable carrying of the briefcase without detracting from the aesthetics of the briefcase.

SUMMARY OF THE DISCLOSURE

The present disclosure provides for an improved storage bag. The improved bag includes a main bag having front, back, bottom and side walls forming an enclosed space with a top opening. A retaining member is disposed on an inside surface of a first side wall of the main bag. The retaining member is adapted to couple with a supplemental bag which can hang on the outside of the main bag.

The disclosure further provides for an apparatus for adapting a briefcase to have the ability to carry a supplemental bag. The apparatus comprises a bracket configured to extend partially along an inside portion of a side wall of the briefcase. The bracket has a hook-portion to extend out of the top of the briefcase, and partially along the outside portion of the side wall of the briefcase. A retaining member is disposed on the bracket. This structure allows for the supplemental bag to be attached to the retaining member and hang along an outside wall of the briefcase.

The disclosure further provides method for configuring a briefcase to carry a supplemental bag. The method comprises the steps of: providing at least one attachment means to be placed adjacent an inner wall of the briefcase; providing a supplemental bag to be disposed on an outer wall of the briefcase; and configuring the supplemental bag to attach to the briefcase using the attachment means adjacent the inner wall of the briefcase.

The foregoing and other objects, features and advantages of the invention will become more readily apparent from the following detailed description of the preferred embodiments of the invention that proceeds with reference to the accompanying drawings.

DETAILED DESCRIPTION

Figure 1:
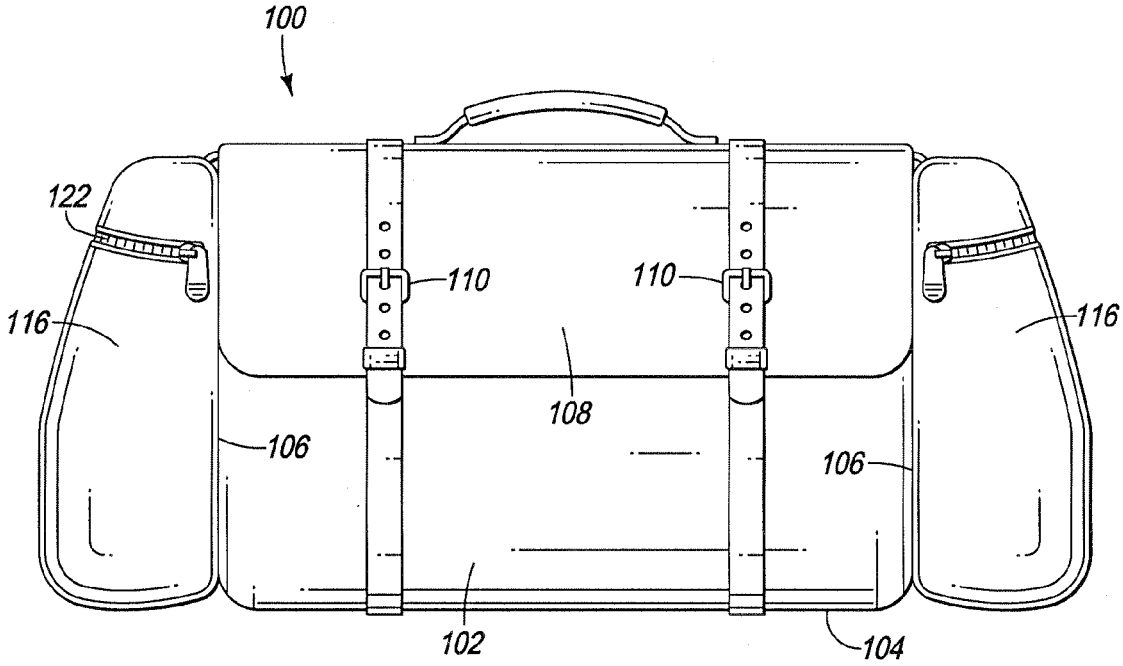
FIG. 1 is a front view of a briefcase with attached supplemental bags in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the disclosure.

Figure 2:
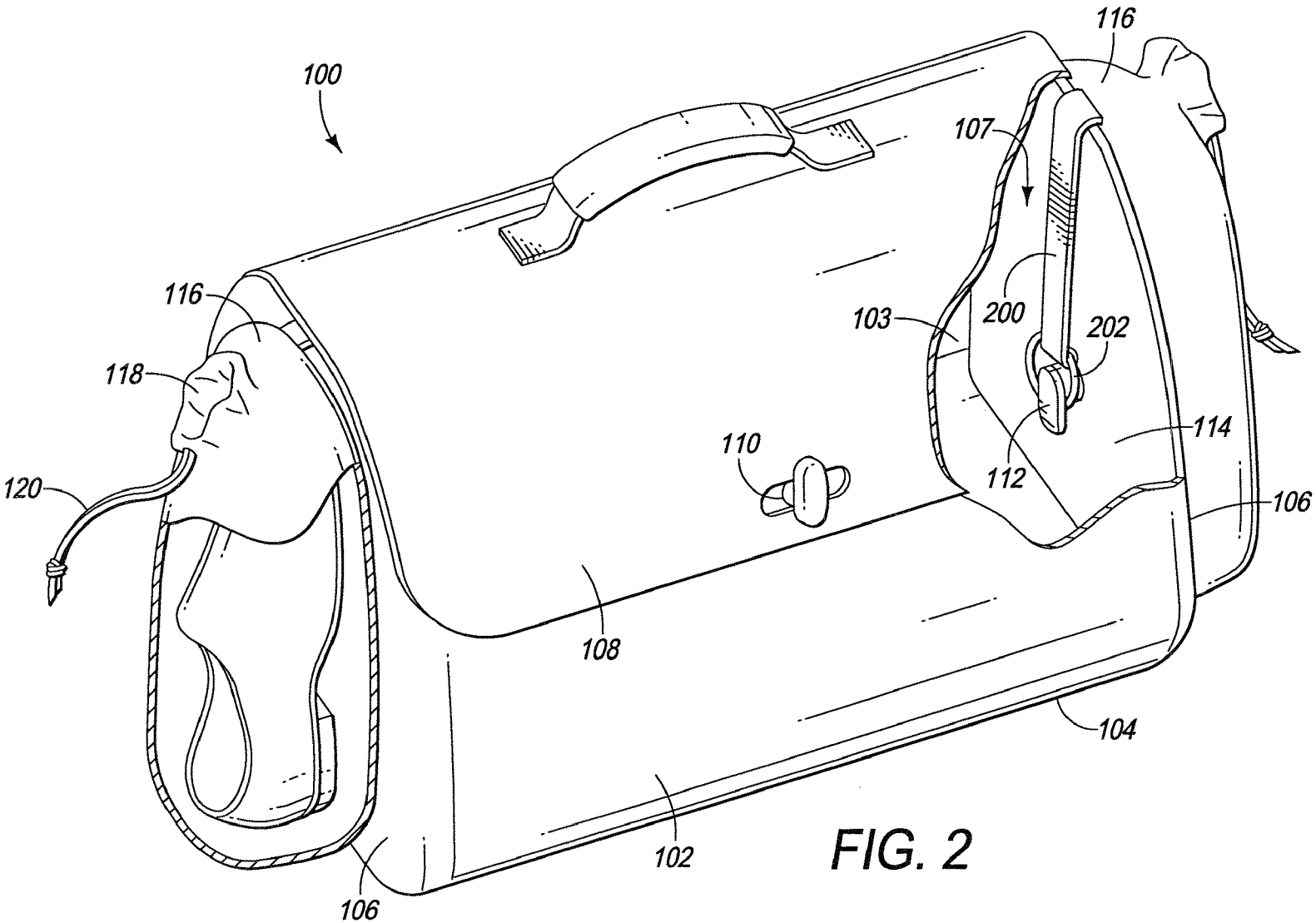
FIG. 2 is a perspective view in partial section of a briefcase with attached supplemental bags in accordance with an embodiment of the present invention.

As illustrated in FIGS. 1 and 2 a main bag 100 has a front 102, back 103, bottom 104 and side 106 walls forming an enclosed space with top opening 107. It is noted that the terms main bag and briefcase are used throughout this disclosure and are meant to be able to be used interchangeably. The main bag 100 can be any bag configured to be carried in a briefcase-style fashion using a top handle or a shoulder strap, and sometimes may also be referred to as a laptop bag or portfolio. The main bag 100 may further include a cover flap 108 attached to a back of the main bag and adapted to fold over the open top of the main bag and attach to the front 102, as via clasp or buckles 110, to protect the enclosed space from exposure to the elements. Many other enclosure methods may be used for various needs or aesthetic purposes, such methods are well known within the art.

A retaining member 112 is disposed on, and sitting adjacent to, an inside surface 114 of a first side wall 106 of the main bag 100. The retaining member 112 is of a type adapted to couple with a supplemental bag 116 hanging on an outside wall of the main bag 100. The retaining member 112 can be a hook or a knob or any other design such that the supplemental bag 116 can attach to the retaining member 112 in a secure manner. The hook 112 shown includes a terminal end that is bent down to face the bottom wall 104 of briefcase 100. In the alternative, the retaining member can be a knob having flared ends, wherein the distal end of a coupler 200, formed of a loop 202, is adapted to be retained by the knob. The main bag 100 may have multiple retaining members disposed on the inner surface 114 of the side wall 106. In one preferred embodiment the main bag 100 has two retaining members, one on each inner surface 114 of opposing side walls 106.

Figure 3:
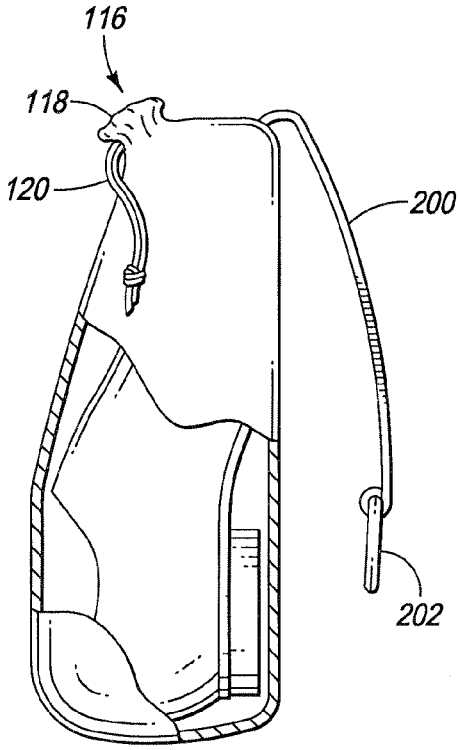
FIG. 3 is a side view of a supplemental bag in accordance with an embodiment of the present invention shown in partial section.

The description now proceeds with reference to FIGS. 2 and 3. A supplemental bag 116 has an opening 118 for receiving an item to carry. The supplemental bag is configured to be disposed on an outside surface of a side wall 106 of the main bag 100. The supplemental bag 116 may be any shape or size depending on the desired carrying capacity. The supplemental bag 116 may also be constructed with any material to accomplish aesthetic goals, to give optimum weather protection, etc. The opening 118 of the supplemental bag 116 is to enable items to be inserted and removed from the supplemental bag 116. The opening 118 can be sealed of using various methods. FIGS. 2 and 3 show an embodiment where the supplemental bag is sealed with drawstrings 120, whereas FIGS. 1 and 4 implement a zipper 122. These methods are shown for illustration purposes as there are many means known in the art that are capable of sealing the opening 118 of the supplemental bag 116.

The supplemental bag also can have a coupler 200 attached at a proximal end to the supplemental bag and at a distal end to the retaining member 112. The coupler 200 is preferably designed to pass through the open top 107 of the main bag 100. The coupler 200 may be made from any material such as leather or an elastic-type material, to a more rigid plastic or metal form. The distal end of the coupler 200 may have a loop 202 designed to loop around the retaining member 112, but many other means to secure the coupler 200 to the retaining member 112 such as using a hook, or directly tying the coupler down may also be used. A loop may also be formed continuously as part of the coupler 200 material.

As part of a preferred embodiment, two supplemental bags 116 may be provided to attach to retaining members 112 and hang on opposing ends of the briefcase as shown by FIG. 1. Further in one embodiment, the supplemental bags 116 may be sized to fit shoes through their respective openings 118.

Figure 4:
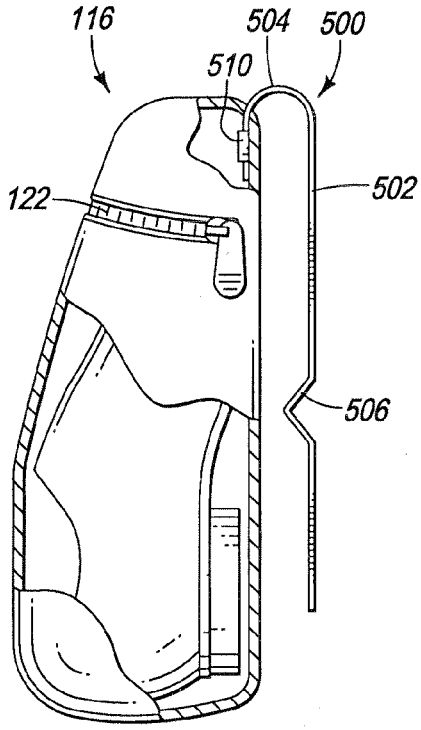
FIG. 4 is a side view of another supplemental bag in accordance with an embodiment of the present invention shown in partial section.
Figure 6:
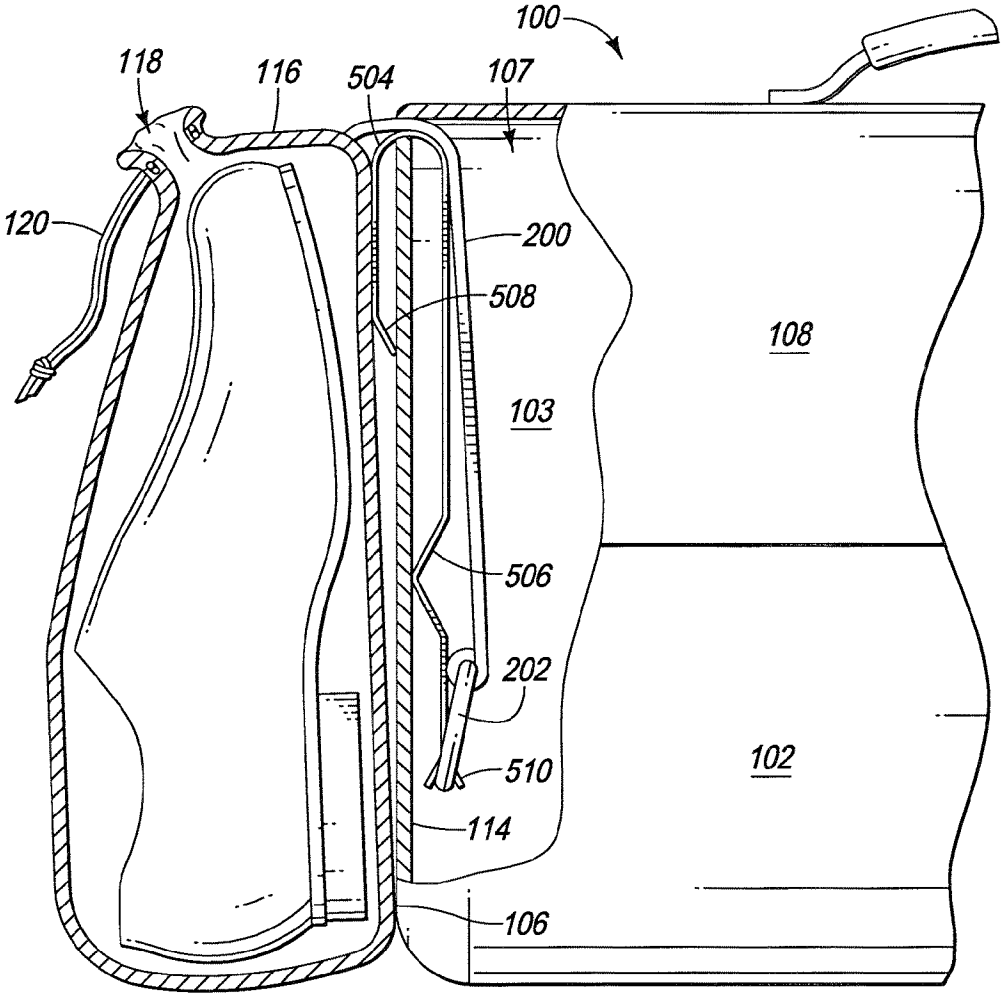
FIG. 6 is a front view in partial section of a briefcase adapted to carry a supplemental bag in accordance with an embodiment of the present invention.
Figure 5:
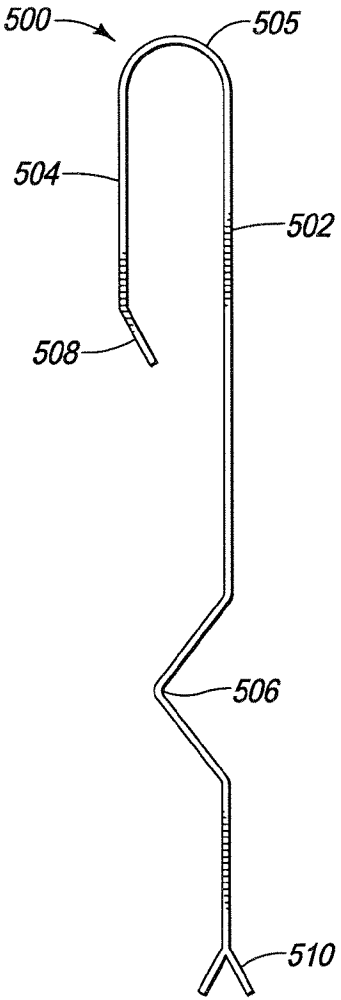
FIG. 5 is a bracket for adapting a briefcase in accordance with an embodiment of the present invention.

FIGS. 4-6 illustrate an apparatus for adapting an existing briefcase to have the ability to carry a supplemental bag 116. A bracket 500 is configured to extend partially along an inside portion 114 of a side wall 106 of the briefcase at 502. The bracket 500 has a hook-portion 504 to extend out of the top 107 of the briefcase and partially along the outside portion of the side wall 106 of the briefcase 100. The bracket 500 may be made from any material that would allow it to fulfill its intended purpose, and is preferably made from a rigid plastic or metal material. In one embodiment, the bracket 500 may have an indent 506 located on the inside portion 114 of the briefcase to anchor the bracket 500 to the briefcase 100. The bracket may also have an indent portion 508 at the end of the hook-portion 504 of the bracket to anchor the bracket 500 to the briefcase 100.

FIG. 4 illustrates a supplemental bag 116 with an integrated clip 500 where the hook portion is affixed to bag 116 via a retaining member 510. In a preferred embodiment, the retaining member 510 affixes the integrated clip 500 to a sidewall of bag 116 (e.g. the sidewall intended to be directly adjacent to briefcase 100) using a stud 510 or plurality of studs, stitches, and the like passing through the bag sidewall and hook portion 504. An indent 506 formed in the inserted end 502 of bracket 500 is intended to bias against an inside wall of the briefcase when inserted to thus retain the bracket 500 and affixed supplemental bag 116 thereto. Accordingly, there is no need for a hook, knob, or other retaining means 510 on the terminal end of the inserted end 502 as shown in FIGS. 5 and 6.

Bracket 500 can alternately be described as having an inserted end 502 coupled to an external end 504 by a bridge portion 505 forming the hook. Indents 506, 508 may be placed on the inserted and extending ends, respectively. And via the bridge portion 505, said indents 506, 508 provide biasing forces against respective walls of the briefcase to squeeze the briefcase sidewall 106 therebetween. As a result, the bracket 500 is held in place on the briefcase 100.

A retaining member 510 is disposed on the bracket 500. The retaining member 510 allows the supplemental bag 116 to be attached to the bracket 500 and hang along an outside wall of the briefcase. FIGS. 5 and 6 show the retaining member 510 as a v-shaped extension formed on the terminal end of the inside portion 502 of the bracket 500, capable of receiving a loop 202 from a supplemental bag 116. This v-shaped extension faces the bottom wall 104 of briefcase 100. It should be noted that the retaining member 510 can be any shape such as the hooks and knobs as discussed above, in the place of the v-shaped extension, or any other means to allow attachment of the supplemental bag 116 to the bracket 500. For example, FIG. 4 shows a retaining member 510 located on the hook portion 504 of the bracket 500. In this embodiment, the retaining member 510 can be a band or stitching to secure the bracket 500 to the supplemental bag 116. This configuration may allow the bag 116 and bracket 500 to be permanently fixed, or to be separately connectable, to be later attached to the main bag 100.

A method is also provided for configuring a briefcase to carry a supplemental bag. The method includes the steps of providing at least one attachment means 112 to be placed adjacent an inner wall 114 of the briefcase 100, and a supplemental bag 116 to be disposed on an outer side wall 106 of the briefcase 100. The method also calls for configuring the supplemental bag 116 to attach to the briefcase 100 using the attachment means 112 adjacent the inner wall 114 of the briefcase 100. The attachment means 112 can be the various retaining member embodiments discussed above, or any other device that can secure the supplemental bag 116.

In a more specific embodiment, the method can also comprise the steps of providing a second attachment means 112 to be placed on an opposing inner wall 114 of the briefcase 100 along with providing a second supplemental bag 116 to be disposed on an outer wall of the briefcase. Further, the method calls for configuring the second supplemental bag 116 to attach to the briefcase 100 using the second attachment means 112 on the inner wall 114 of the briefcase 100.

In yet another embodiment of the method providing the attachment means 112 can include configuring a removable clip 500 to have an inserted end 502 coupled to an external end 504 by a bridge portion 505; forming the attachment means 510 on a terminal end of the inserted end 502; and inserting the clip 500 over a wall of the briefcase 100 so that the inserted end 502 contacts the inner wall 114 and the external end 504 contacts an outer side wall 106 of the briefcase 100.

It is to be understood that the above-referenced arrangements are only illustrative of the application for the principles of the present invention. Numerous modifications and alternative arrangements can be devised without departing from the spirit and scope of the present disclosure. While embodiments of the present invention have been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts as set forth herein. I claim all modifications and variation coming within the spirit and scope of the following claims.

I claim:

1. An apparatus for adapting a briefcase to have the ability to carry a supplemental bag, said apparatus comprising:

a bracket having inside and outside portions coupled by a hook-portion and configured to extend partially along an inside portion of a side wall of the briefcase and within a main enclosed space thereof, said bracket having the hook-portion to extend out of a top of the briefcase and partially along an outside portion of the side wall of the briefcase; and a retaining member disposed on the inside portion of the bracket and configured to couple with a supplemental bag hanging along an outside wall of the briefcase.

2. The apparatus of claim 1 wherein the bracket further comprises an indent located on the inside portion for the briefcase to anchor the bracket to the briefcase.

3. The apparatus of claim 1 wherein the bracket further comprises an indent portion at an outside portion end of the hook-portion of the bracket to anchor the bracket to the briefcase.

4. The apparatus of claim 1 wherein the retaining member is a hook to be disposed on the inside of the briefcase and facing the bottom wall of the briefcase such that a supplemental bag configured to hang along an outside wall of the briefcase can loop around the hook and up and out of the briefcase.

5. The apparatus of claim 1 further comprising a supplemental bag configured to attach to the retaining member on the inside of the briefcase and hang on the outside wall of the briefcase.

6. The apparatus of claim 1 wherein the retaining member is disposed on the hook portion of the bracket.

7. The apparatus of claim 6 further comprising a supplemental bag configured to attach to the retaining member on the hook portion of the bracket and hang on the outside wall of the briefcase.

* * * * *